US010030952B1

(12) United States Patent
Stofko et al.

(10) Patent No.: US 10,030,952 B1
(45) Date of Patent: Jul. 24, 2018

(54) THERMALLY DEPLOYABLE SHROUD FOR AFFORDABLE PRECISION GUIDED PROJECTILE

(71) Applicant: The United States of America as Represented by the Secretary of the Army, Washington, DC (US)

(72) Inventors: Pavol Stofko, Milford, PA (US); Mark Mellini, Denville, NJ (US); Christopher Stout, Marlboro, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/474,062

(22) Filed: Mar. 30, 2017

(51) Int. Cl.
*F42B 12/46* (2006.01)
*F42B 10/46* (2006.01)

(52) U.S. Cl.
CPC ..... *F42B 10/46* (2013.01)

(58) Field of Classification Search
CPC ..... F42B 10/46; F42B 10/32; F42B 10/10
USPC ..... 102/377; 244/3.25, 121, 171.7
See application file for complete search history.

(56) References Cited

U.S. PATENT DOCUMENTS

| | | | | |
|---|---|---|---|---|
| 7,661,625 | B2 | 2/2010 | Rieger | |
| 8,058,595 | B2 * | 11/2011 | Koehler | B64C 1/36 244/121 |
| 8,505,455 | B2 | 8/2013 | Fisch | |
| 2005/0000383 | A1 | 1/2005 | Facciano | |
| 2011/0192308 | A1 * | 8/2011 | Fisch | F42B 10/46 102/377 |
| 2013/0214093 | A1 * | 8/2013 | White | B64C 7/00 244/121 |
| 2017/0108319 | A1 * | 4/2017 | Boiman | H01Q 1/281 |

* cited by examiner

*Primary Examiner* — J. Woodrow Eldred
(74) *Attorney, Agent, or Firm* — John P. DiScala

(57) ABSTRACT

A deployable shroud provides an aerodynamically smooth surface to minimize the drag otherwise experienced by blunt nose projectiles. The shroud comprises multiple petals mounted at the nose of the projectile that are released at a set time during flight. The deployment mechanism assembly of the shroud provides deployment of the petals without the generation of shock waves into the projectile and comprises a fusible link powered by a thermal source. The shroud assembly is self-powered and does not require energy input from the projectile.

11 Claims, 6 Drawing Sheets

THERMALLY DEPLOYABLE SHROUD FOR AFFORDABLE PRECISION GUIDED PROJECTILE

FEDERAL RESEARCH STATEMENT

The invention described herein may be manufactured, used, and licensed by or for the U.S. Government for U.S. Government purposes.

BACKGROUND OF INVENTION

Field of the Invention

The present invention relates to projectiles and more particularly, shrouds for projectiles.

Related Art

Due to the technological advances in the art, standard or non-custom sensor packages are increasingly becoming smaller and more affordable. From a design aspect, sensor package size is often the restricting parameter for the available space claim in many projectiles. Most designs that attempt the integration with standard sensor packages, especially at the nose end of the projectile, result in a blunt nose design. This is not always ideal from the aerodynamic perspective.

To avoid the loss of range, maneuverability, and aerodynamic stability of blunt nose designs, a shroud is sometimes affixed to the projectile to minimize the effects on the aerodynamic performance. However, previous deploying shroud, or dual nose cone designs all consist of some type of a pyrotechnic actuator as the deployment mechanism. Pyrotechnic actuators have been found to generate significant shock waves that travel into the body of the projectile. These shock waves negatively affect internal measurement units (IMU) and other types of sensors degrading their performance and therefore the overall performance of the projectile. Accordingly, improvements to the design of shroud deployment mechanisms are desirable for projectiles containing sensitive electronic packages.

SUMMARY OF INVENTION

The present invention relates to a deploying shroud for a projectile.

According to a first aspect of the invention, a shroud for a projectile includes one or more petals and a deployment mechanism assembly for deploying the one or more petals at a specified time. During operation, the deployment mechanism assembly does not generate shock loads within the projectile.

According to a second aspect of the invention, a method for deploying a shroud from a projectile includes the steps of connecting one or more petals to the projectile via a hinge, placing the one or more petals under elastic tension by a spring, providing a restraining force on the one or more petals to balance the elastic tension through a thermally actuated link to the projectile, launching the projectile, releasing the restraining force by actuating the thermally actuated link, rotating the petals outward with respect to the longitudinal axis of the projectile through the elastic force of the spring, and allowing an airstream to enter the interior cavity of the shroud thereby separating the one or more petals from the shroud.

BRIEF DESCRIPTION OF THE DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

DETAILED DESCRIPTION

A deployable shroud provides an aerodynamically smooth surface to minimize the drag otherwise experienced by blunt nose projectiles. Additionally, the deployable shroud may shield sensitive components of the projectile during gun launch and initial projectile flight. The shroud consists of multiple petals mounted at the nose of a projectile that are released at a set time during flight. Advantageously, the deployment mechanism assembly of the shroud provides for deployment without the generation of shock waves into the projectile. Additionally, the shroud is completely self-powered thereby not requiring any energy input from the projectile itself.

While a gun launched projectile, such as an artillery or mortar projectile, is used throughout this specification to illustrate the deployable shroud, the deployable shroud is not limited to a gun launched projectile. The deployable shroud described herein is suitable for any device which travels in a medium and requires a deployable surface for protection from the environment or an aerodynamically smooth surface.

Figure 1:
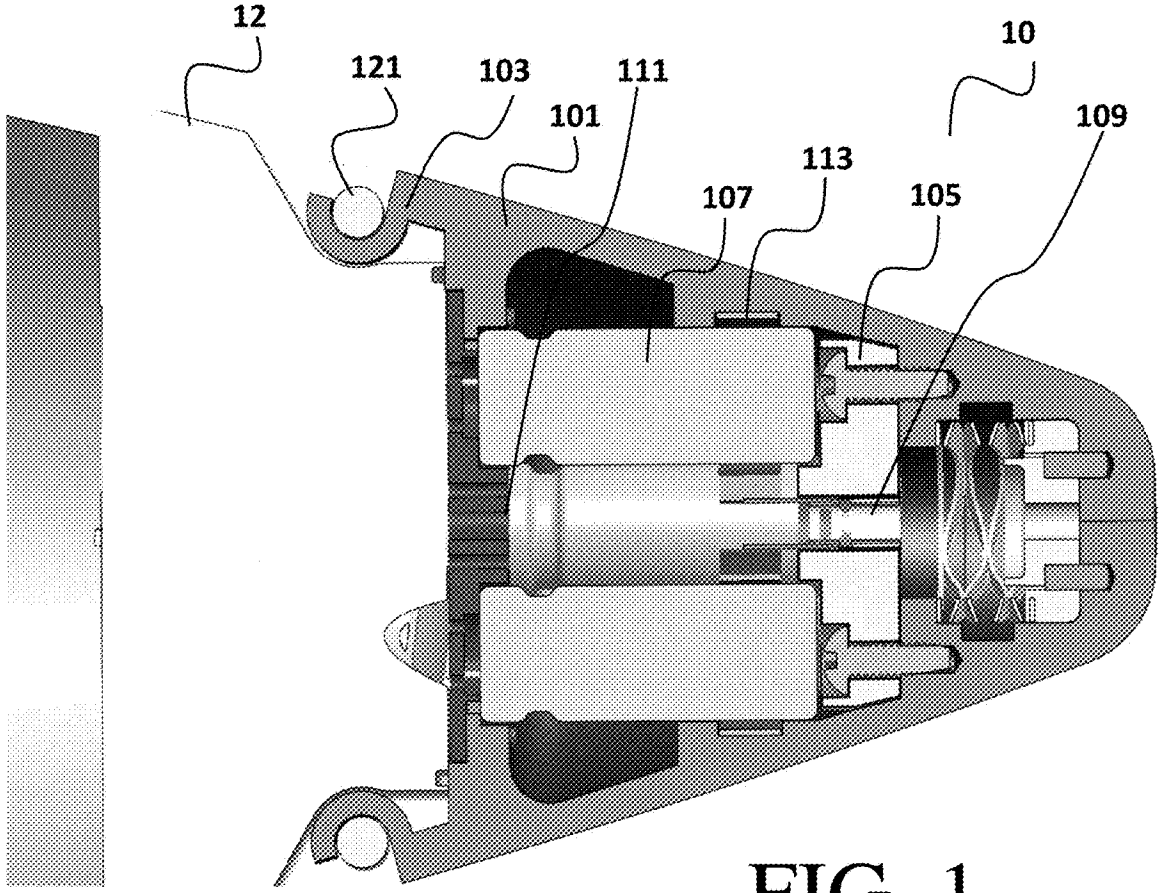
FIG. 1 is a cross-section view of a deployable shroud, in accordance with an illustrative embodiment of the invention.

FIG. 1 is a cross-section view of a deployable shroud in a closed configuration, in accordance with an illustrative embodiment of the invention. The shroud assembly 1 comprises four individual petals 101 which are deployed at a specified time during the flight of the projectile 12. The petals 101 are formed of a rigid material, such as metal or plastic, thereby providing the necessary stability and protection during gun launch and flight. While in the closed configuration, the outer surface of the petals 101 form an aerodynamically desirable shape for the projectile 12 and covers the front surface of the nose of the projectile 12.

Together with the front surface of the nose, the four petals 101 define an interior cavity, which houses the deployment mechanism assembly.

Each of the petals 101 is secured to the projectile 12 by a half hinge 103 around a pin 105 disposed on the nose of the projectile 12. While in the closed position, the half hinge 103 secures the petal 101 to the projectile 12. However, upon initiation of the deployment mechanism assembly, the half hinge 103 allows the petals 101 to rotate out of alignment with the pin 105 and freely separate. As will be described in detail further detail below, prior to initiation of the deployment mechanism assembly, the four petals 101 are held in the closed position and prevented from rotating about the half hinge 103 by heater fingers 105 and a safety mechanism assembly. Additionally, four leaf springs 113 under elastic tension are housed in the petals and provide an outward force on the petals when the deployment mechanism assembly is initiated.

Each of the petals 101 houses an energy storage device 107 for powering a heating element 109 of the deployment mechanism assembly. For example, an embodiment of the invention comprises four supercapacitors 107. However, the capacitance of the energy storage device 107 may be greater or lesser than a supercapacitor depending the specific application and the energy requirements of the heater element 109. Each supercapacitor is captured between a heater finger 105 and a connector cap 111.

The connector cap 111 serves to hold the capacitors in place as well provide electrical connection between the capacitors and electrical spring contacts 505. The electrical connection provided by the connector cap may be utilized as a communication path such as by allowing the elements of the projectile to send one or more electrical signals instructing the shroud to initiate deployment.

Each petal 101 additionally houses a heater finger 105. Each heater finger 105 is physically mounted to its corresponding petal 101 and is detachably connected to the heating element 109 by a fused joint which restricts the petal 101 from opening (i.e. rotating about hinge) until the deployment mechanism assembly is engaged.

Figure 2:
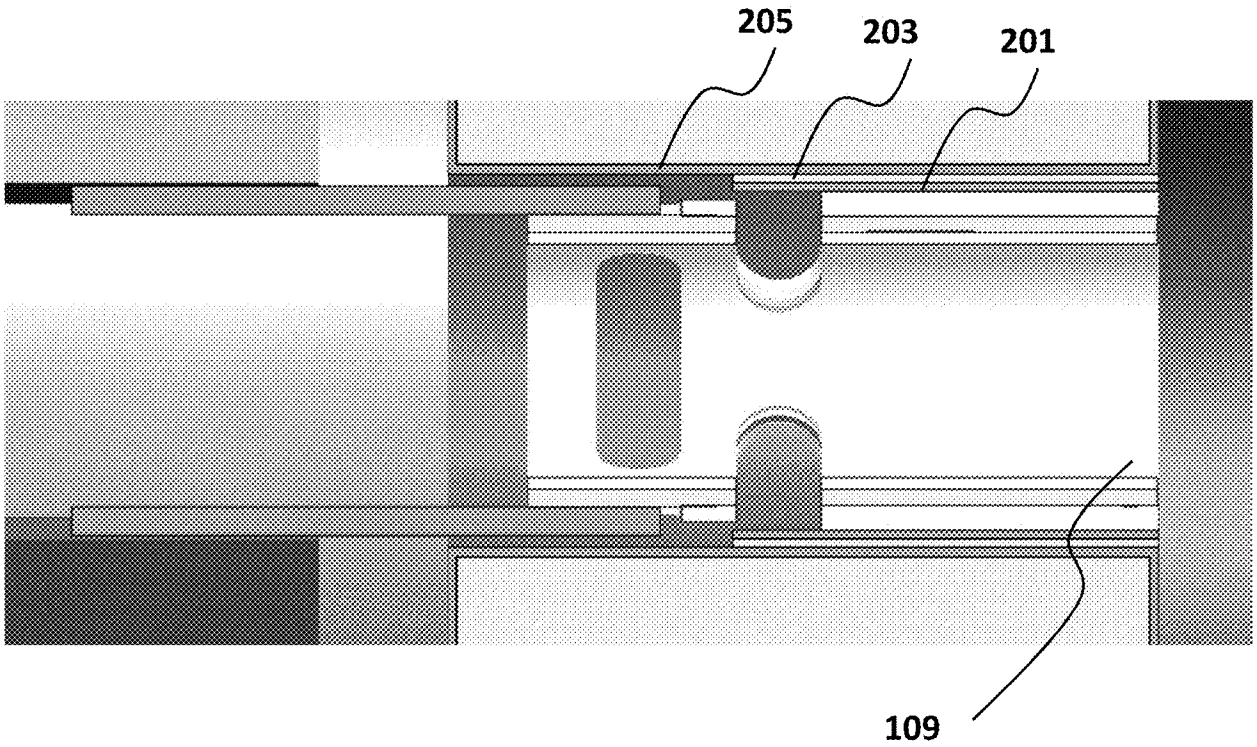
FIG. 2 is a cross-section view of a fused joint of the deployable shroud, in accordance with an illustrative embodiment of the invention.

FIG. 2 is a cross-section view of a fused joint of the deployable shroud, in accordance with an illustrative embodiment of the invention. A heater element 109 is captured inside the four heater fingers 105 via fusible joint. The fusible joint is created by melting a fusible alloy ribbon 201 between a copper surface of the heater element 203 and a copper surface 205 of each of the heater fingers 105 creating a fused joint. The fused joint provides a restrictive force to counter the force on the petals 101 caused by the springs 113 and retains the petals 101 in the closed position. In an embodiment of the invention, the fusible alloy ribbon is made of low melting temperature solder material.

The heater element 109 is a resistive heating element for melting the fused link upon initiation of the deployment mechanism assembly. Advantageously, the heating element is entirely powered by the capacitor bank of the deployment mechanism assembly thereby negating the need for any power from the projectile 12 itself after initial set.

The capacitors are charged during an initial set of the projectile before launch or firing. In an embodiment, electronics on board the projectile monitor the capacitor charge. For reliability and backup purposes, if necessary, the capacitors may be recharged from a power source of the projectile, such as a battery.

Figure 3A:
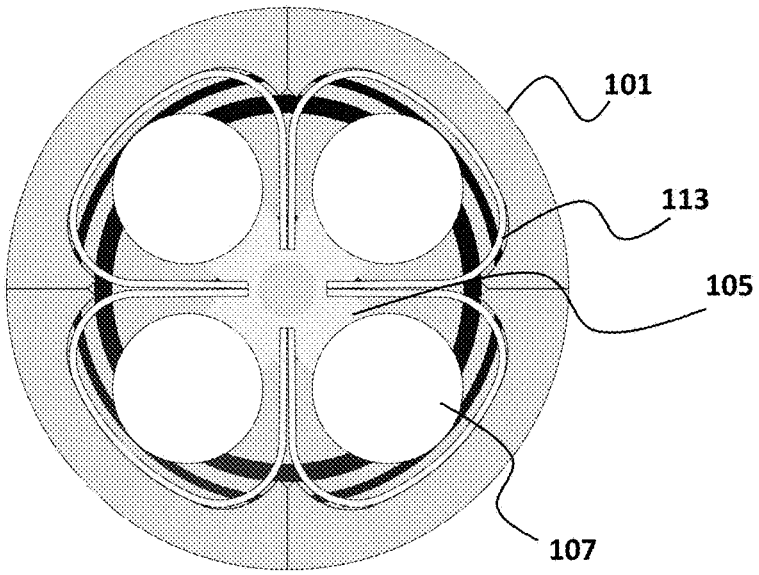
FIG. 3A illustrates the shroud in a closed position, in accordance with an illustrative embodiment.
Figure 3B:
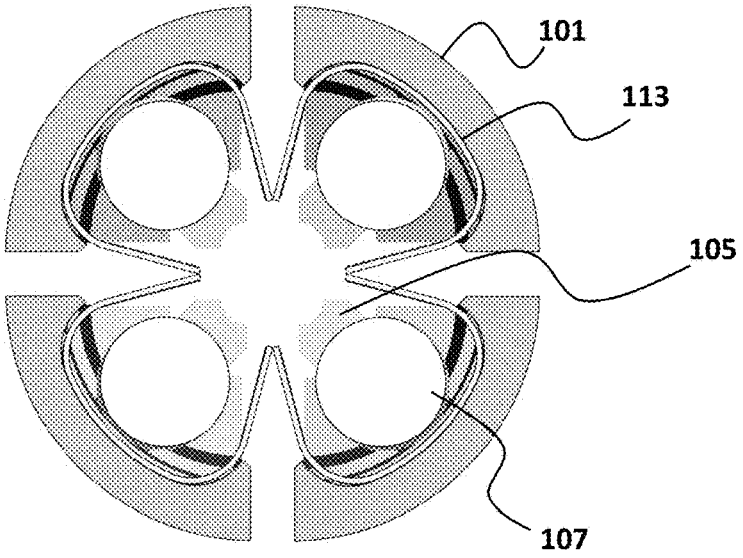
FIG. 3B illustrates the shroud in an open position, in accordance with an illustrative embodiment.

FIG. 3A illustrates the shroud in a closed position, in accordance with an illustrative embodiment. FIG. 3B illustrates the shroud in an open position, in accordance with an illustrative embodiment. The petals 101 are spring loaded via the four leaf springs 113. The springs 113 open the petals 101 by 15 degrees radially from the center axis after the deployment mechanism assembly is actuated. The air stream of the projectile 12 on the increased drag of the petals 101 provides the additional opening force required to fully deploy the petals 101.

Figure 4A:
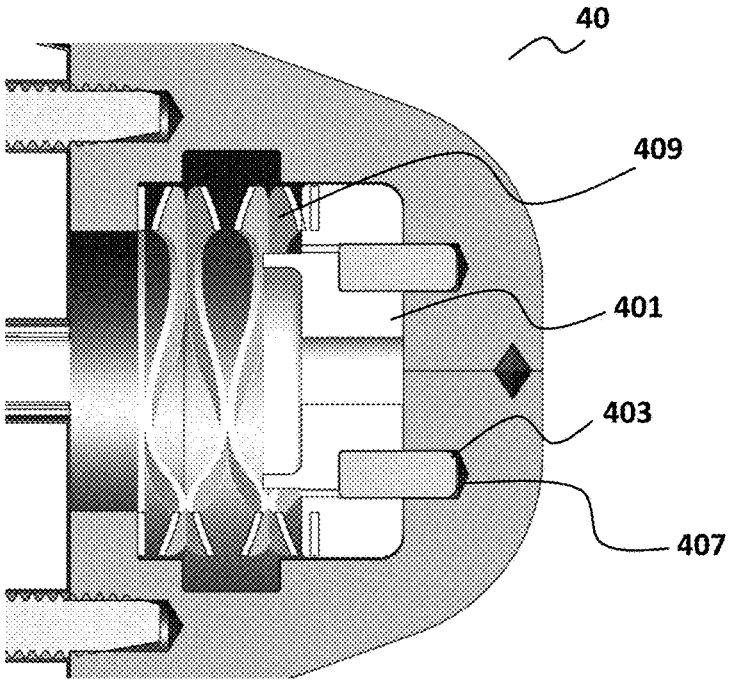
FIG. 4A illustrates a cross-section view of the safety mechanism assembly in an engaged position, in accordance with an illustrative embodiment.
Figure 4B:
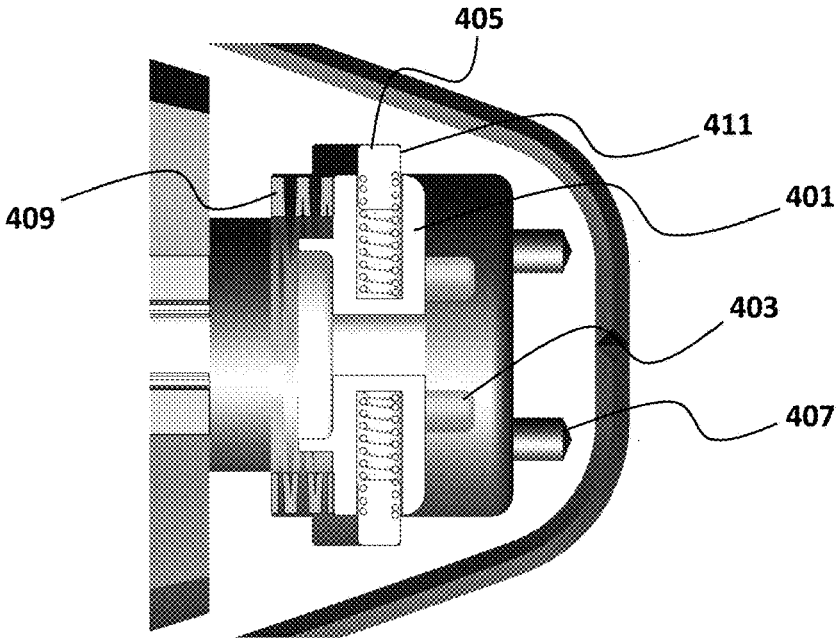
FIG. 4B illustrates a cross-section view of the safety mechanism assembly in a disengaged position, in accordance with an illustrative embodiment.

FIG. 4A illustrates a cross-section view of the safety mechanism assembly in an engaged position, in accordance with an illustrative embodiment. FIG. 4B illustrates a cross-section view of the safety mechanism assembly in a disengaged position, in accordance with an illustrative embodiment. The petals 101 are connected to the nose of the projectile 12 via half hinge 103. This allows the petals 101 to rotate out of alignment with the pin 121 and freely separate from the projectile 12. The front of the shroud contains a safety mechanism assembly 40 to provide an extra locking feature and prevent the shroud from prematurely opening during storage or transport if the fused solder joint physically breaks because of an external force such as a drop.

The safety mechanism assembly 40 comprising a safety bobbin 401. The bobbin 401 further contains four axially located pins 403 and two radially located pins 405. The axial pins 403 engage holes 407 formed in the interior surfaces of the petals 101 to hold the shroud assembly in the closed configuration until gun launch occurs. Once the axial gun launch acceleration is present, a bobbin spring 409 compresses due to bobbin's inertia. The axial pins 403 are then disengaged from the petal holes 407. At the same time, the spring loaded radial pins 405 hold the bobbin 401 in a disengaged position by engaging into an outer radial petal groove 411. At this point, the fusible joint is the only thing restraining the petals 101 from rotating about the hinge 103 and thereby holding the shroud together in the closed position.

Figure 5A:
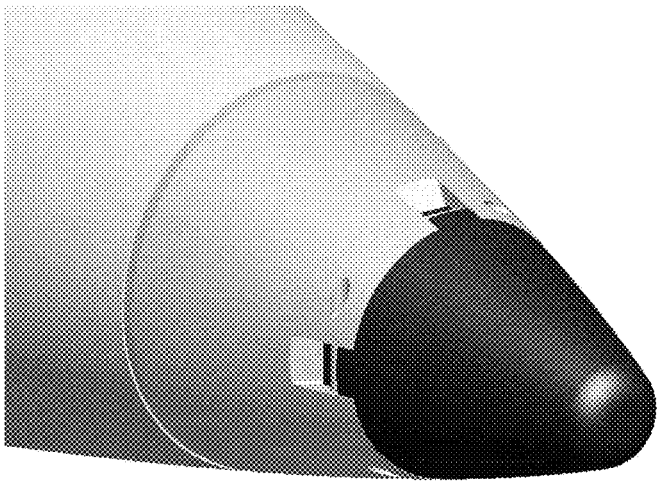
FIG. 5A illustrates the shroud in a closed position, in accordance with an illustrative embodiment.
Figure 5B:
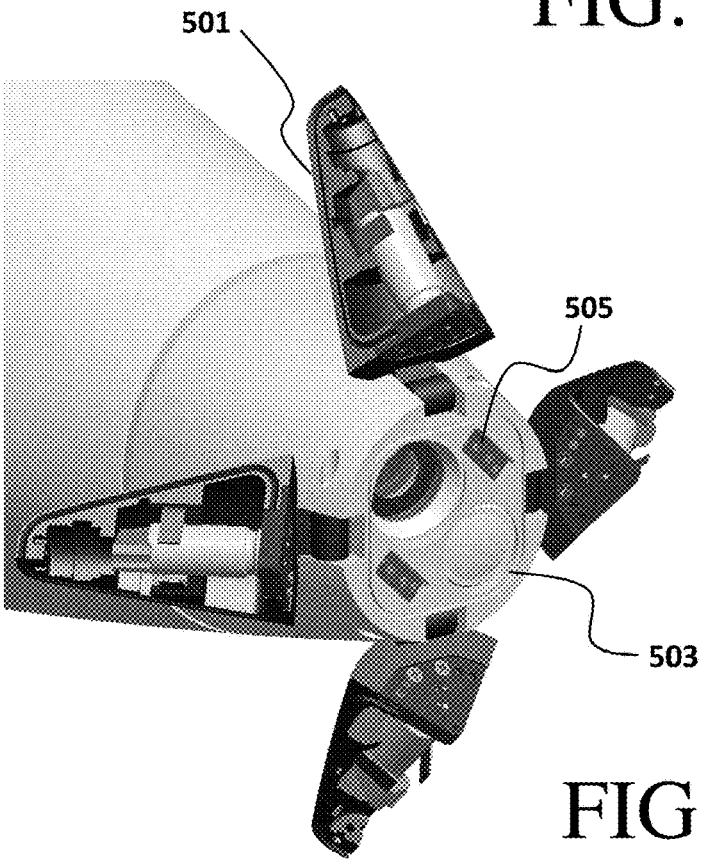
FIG. 5B illustrates the shroud in an open position, in accordance with an illustrative embodiment.

FIG. 5A illustrates the shroud in a closed position, in accordance with an illustrative embodiment of the invention. FIG. 5B illustrates the shroud in an open position immediately before full disengagement of the hinges, in accordance with an illustrative embodiment of the present invention. The shroud assembly is sealed against water leakage using a custom shaped rubber seal cord inside the gland 501 running down the sides of two petals 101 and compressing against the other petal faces. The rear axial face of the shroud assembly is also sealed using a rubber seal cord inside the gland 503. The shroud is initially in a closed position prior to operation. The shroud is placed in the closed position by assembling the petals 101 about the hinge joint, creating the fused link between the heater fingers 105 and the heating element and engaging the safety mechanism. Electrical spring contacts 505 protrude from an opening in the front face of the projectile. The electrical spring contacts 505 provide electrical connection between the capacitors 107 and the projectile power electronics for charging and actuation signal purposes.

Figure 6:
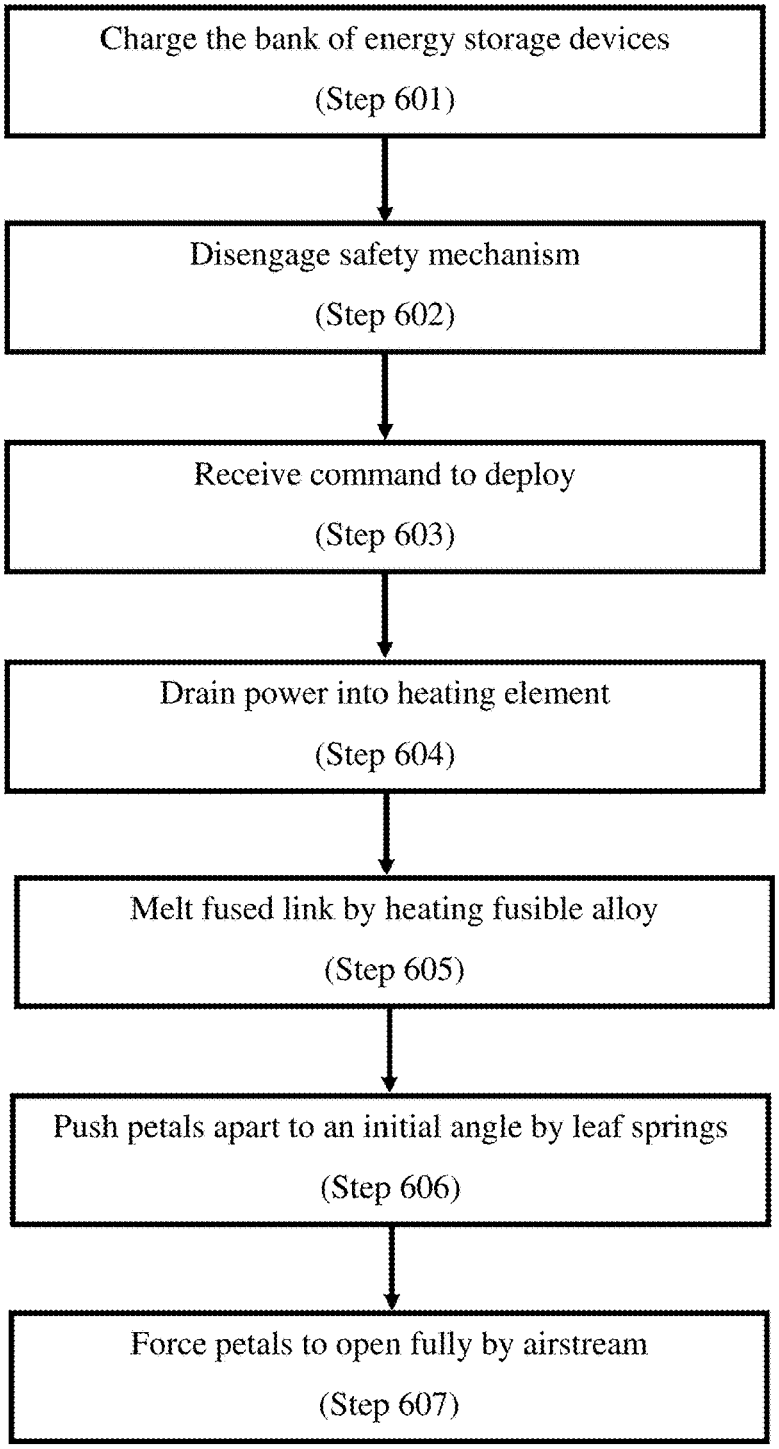
FIG. 6 is a flowchart illustrating steps for a method of deploying a shroud from a projectile, in accordance with an illustrative embodiment.

FIG. 6 is a flowchart illustrating steps for a method of deploying a shroud from a projectile, in accordance with an illustrative embodiment.

At step 601, prior to gun launch, the bank of supercapacitors 107 is charged from an external power source which connects to the capacitors 107 through one or more electrical spring contacts 505 in the connector cap 111.

Subsequent to gun launch, at step 602, the safety mechanism 40 is disengaged due to the inertial forces generated during gun launch. Once the axial gun launch acceleration is present, the bobbin spring 409 compresses due to the bobbin's inertia. The axial pins 403 are then disengaged from the petal holes 407. At the same time, the spring loaded radial pins 405 hold the bobbin 401 in a disengaged position by engaging into an outer radial petal groove 411.

At step 602, the shroud receives a command to deploy. The command may be received from an external source or may be generated internally by software and/or hardware residing on the projectile 12 according to one or more factors including but not limited to time of flight, flight characteristics such as velocity or acceleration, orientation and location.

Once the shroud receives the command to deploy, at step 603, the bank of capacitors 107 drains its power into the heating element 109.

At step 604, the heating element 109 heats the fusible alloy 203 to a temperature sufficient to melt the fused link. For example, in the embodiment of the invention described above in which the fusible alloy 203 is low temperature melt point solder material, the heating element 109 heats the temperature to the desired temperature to break the solder joint. The fusible alloy 203 melts within the desired design time, breaking the joint with the heater fingers 105.

At step 605, the leaf springs 113, no longer balanced by the restrictive force of the fused link push the petals 101 apart to an initial angle from the central axis of the shroud. By pushing the petals 101 apart, such as by a designed amount of degrees, the drag profile of the petals 101 is increased and the interior cavity of the petals 101 is exposed to the airstream flowing past the projectile 12.

At step 606, the incoming airstream is enters the interior of the shroud and forces the petals 101 to open all the way, rotating out of the hinges and freely separating from the projectile 12. The petals 101 including the capacitors, heater fingers 105 and safety mechanism assembly 40, as well as the heater element 109 and connector cap separate into the environment and the projectile 12 continues on its path.

We claim:

1. A shroud for a projectile comprising one or more petals restrained from rotating about an axis of the projectile and a deployment mechanism assembly for deploying the one or more petals at a specified time by releasing a thermally actuated link securing the one or more petals to the projectile thereby allowing the one or more petals to rotate about the axis of the projectile under the force of an incoming air stream, the thermally actuated link further comprising a fused joint connecting one or more heater fingers to the projectile wherein each of the one or more heater fingers is housed within a petal.

2. The shroud of claim 1 wherein the fused joint is in thermal communication with a heating element.

3. The shroud of claim 2 wherein the heating element receives electric power from one or more capacitors.

4. The shroud of claim 3 wherein the one or more capacitors are charged from an external power source prior to launch of the projectile.

5. The shroud of claim 1 wherein each of the one or more petals are under the elastic tension of a spring.

6. The shroud of claim 5 wherein each of the one or more petals are secured to the projectile via a hinge connector providing a restraining force when the petal is at or below a predetermined angle from a longitudinal axis of the projectile.

7. The shroud of claim 1 further comprising a safety mechanism assembly restraining the one or more petals from rotating with respect to the longitudinal axis of the projectile.

8. The shroud of claim 7 wherein the safety mechanism assembly is disengaged by the inertial force on the safety mechanism assembly during launch of the projectile.

9. The shroud of claim 7 wherein the safety mechanism assembly comprises a bobbin with one or more axial pins for restraining the one or more petals from rotating with respect to the longitudinal axis of the projectile while the safety mechanism assembly is in an engaged position.

10. The shroud of claim 7 wherein the bobbin further comprises one or more radial pins for securing the safety mechanism assembly in the disengaged position subsequent to launch of the projectile.

11. A method for deploying a shroud from a projectile comprising the steps of:

connecting one or more petals to the projectile via a hinge;

placing the one or more petals under elastic tension by a spring;

providing a restraining force on the one or more petals to balance the elastic tension through a thermally actuated link to the projectile;

engaging a safety mechanism assembly restraining the one or more petals from rotating with respect to the longitudinal axis of the projectile;

launching the projectile;

disengaging a safety mechanism assembly restraining the one or more petals with the propulsive force of launching the projectile; and releasing the restraining force by actuating the thermally actuated link;

rotating the petals outward with respect to the longitudinal axis of the projectile through the elastic force of the spring allowing an airstream to enter the interior cavity of the shroud thereby separating the one or more petals from the shroud.

* * * * *